United States Patent [19]

Sommerhoff

[11] Patent Number: 4,559,706

[45] Date of Patent: Dec. 24, 1985

[54] APPARATUS FOR FORMING MOON CHARACTERS FOR THE VISUALLY HANDICAPPED

[75] Inventor: Gerd W. C. Sommerhoff, Sevenoaks, England

[73] Assignee: Possum Controls Limited, Slough, England

[21] Appl. No.: 625,664

[22] Filed: Jun. 28, 1984

[30] Foreign Application Priority Data

Jul. 1, 1983 [GB] United Kingdom ..... 8317995

[51] Int. Cl.[4] ..... B43L 13/10; B41J 5/00

[52] U.S. Cl. ..... 33/23 R; 400/18; 400/87

[58] Field of Search ..... 400/19, 18, 16, 17, 400/87; 33/18 B, 23 R, 23 B, 25 R, 25 B, 25 C, 25 D, 21 R; 346/111; 101/3 R, 4

[56] References Cited

U.S. PATENT DOCUMENTS

| | | | |
|---|---|---|---|
| 4,271 | 11/1845 | Thurber | 400/19 |
| 643,981 | 2/1900 | Robinson | 33/25 B |
| 2,251,616 | 8/1941 | Perry | 400/19 |
| 2,616,198 | 11/1952 | Sewell | 101/3 R X |
| 3,333,341 | 8/1967 | Wuerthner | 33/25 R |
| 4,003,459 | 1/1977 | Moffatt | 400/18 |

*Primary Examiner*—Clifford D. Crowder

*Attorney, Agent, or Firm*—Robert T. Gammons

[57] ABSTRACT

The machine 10 may be used to emboss characters of embossed script, and comprises a paper support 12 and an escapement mechanism 20 from a typewriter. Embossable paper is fed from around a roller 22 to a position between an embossing stylus 14 and a resilient anvil 28. The stylus 14 is moved against the anvil to impress the paper, and moves in a horizontal plane to emboss characters in the paper. A coupling 18 comprising a pantograph mechanism causes the stylus 14 to follow with reduced amplitude, movement of a describing member 16. The describing member 16 is a ring in which the user's finger is placed. The finger is run over a fingerboard 34 to describe the desired character, which is embossed in the paper by the stylus 14. The fingerboard has grooves to guide the finger.

After each character is completed, the escapement mechanism 20 is operated to move the paper support 12 to present a fresh area of the paper to the stylus.

13 Claims, 3 Drawing Figures

APPARATUS FOR FORMING MOON CHARACTERS FOR THE VISUALLY HANDICAPPED

BACKGROUND OF THE INVENTION

The present invention relates to a machine for embossing sheet material, for instance paper. A machine embodying the invention may be used for a variety of purposes, including serving as an aid for blind and partially-sighted people.

Blind people can learn to read by touch, by running a finger over a line of characters embossed in a sheet of paper. Several character systems have been devised. In one of them, the Braille system, characters are made up of embossed dots. Each character is formed by embossing a unique combination of dots selected from an array of six dots. The same six dot array is used for all characters.

The number of distinct characters available in the Braille system makes Braille versatile. Furthermore, since all Braille characters are formed on the same array of dots, the printing of Braille is not difficult. Braille has been widely adopted and a large volume of printed material is available. However, Braille characters bear little or no resemblance to their Roman type equivalents. This makes Braille a difficult system to learn, particularly for those who lose their sight late in life.

The Moon system is an alternative system of embossed writing and was invented in 1847. The characters incorporate embossed lines and curves, and many characters are the same as or closely related to their Roman type equivalents. This makes Moon easier to learn for readers who have had sight, but more difficult to print. It is printed in a way analogous to settable type printing. Each piece of type is an embossing head for embossing one character. The type is assembled to form a page of script which is embossed onto a sheet of paper in one pressing action. Moon material is much slower to print than Braille material, and as a result, a much smaller selection is available to the reader.

Furthermore, the type-setting method has been the only method used for producing Moon material, up to the present date.

SUMMARY OF THE INVENTION

According to the present invention there is provided a sheet material embossing machine for generating a line of embossed characters, characterised by a support for a sheet of embossable material, an embossing stylus movable with respect to the support into and out of a position in which it impresses a sheet held in the support, a describing member movable to describe the outline of a character to be embossed, a coupling between the describing member and the stylus or support causing relative movement between the stylus and support, the relative movement following movement of the describing member, and drive means operable to move the support in step-wise manner relative to the stylus to present successive areas of a sheet to the stylus.

The invention transforms the Moon system from a reading system to a system in which the user can write as well as read. Using a machine embodying the invention, blind Moon readers can write letters to each other, for instance, without having to rely on a sighted person to write the letter in ordinary handwriting, and a sighted person to read the letter to the recipient. The invention also enables Moon writers to write notes for themselves, or shopping lists, for instance, and to prepare labels for jars of food or medicine, for instance.

Preferably the coupling couples the stylus to the describing member and the drive means moves the support while the stylus remains stationary. A pantograph mechanism is preferably incorporated in the coupling so that the relative movement between the stylus and the support is reduced in amplitude with respect to the movement of the describing member.

Preferably the support comprises a roller around which a sheet of embossable material may be coiled, and from around which the sheet may be uncoiled to take up a position in which an area of the sheet is presented to the stylus.

To facilitate coiling and uncoiling of paper around the roller, the machine may further comprise a guide plate movable between a first position in which it guides paper to the roller, for coiling around the roller, and a second position in which it guides paper uncoiled from the roller to the stylus, for embossing. Such a guide plate preferably carries an anvil of resilient material against which the stylus is urged when the stylus is in its sheet-impressing position and the guide plate is in its second position, to emboss a sheet positioned between the stylus and the anvil.

DESCRIPTION OF THE PREFERRED EMBODIMENT

Figure 1:
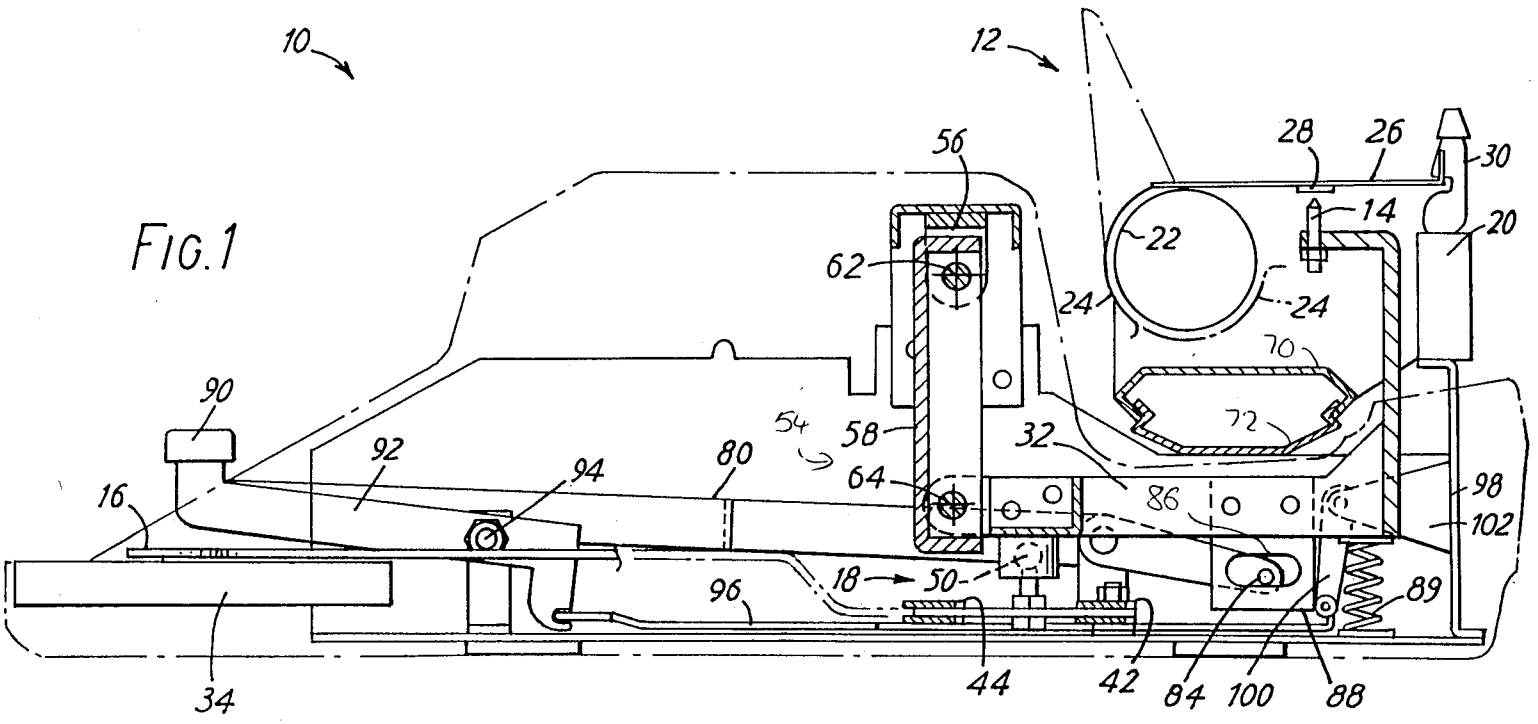
FIG. 1 is a side elevation of the internal mechanism of the machine.

FIG. 1 shows a sheet material embossing machine 10 for generating a line of embossed characters. The machine 10 may be used to emboss paper. The machine 10 comprises a support 12 for a sheet of embossable paper. An embossing stylus 14 is vertically movable into and out of a position in which it impresses paper held in the support 12. A describing member 16 is movable to describe the outline of a character to be embossed. A coupling 18 between the describing member 16 and the stylus 14 causes the stylus 14 to move relative to the support 12, so as to follow movement of the tracing member 16. Escapement mechanism 20 is operable to move the support 12 in a step-wise manner to present successive areas of a sheet of paper to the embossing stylus 14.

The paper support 12 is an adaptation of the carriage mechanism of a typewriter. The support 12 comprises a paper roller 22, rotatable about its cylindrical axis. Arcuate paper guides 24 allow paper to be coiled or uncoiled from around roller 22 (between the surface of the roller 22 and the guides 24). A paper guide plate 26 is hinged at the roller axis and can move between two extreme positions, shown respectively in solid and in ghosted lines in FIG. 1. When the guide plate 26 is in the near vertical position shown ghosted in FIG. 1, the plate 26 guides the leading edge of a sheet of paper offered to it into the space between the roller 22 and the arcuate guide 24, where it may wrap around the roller.

When the guide plate 26 is lowered to its horizontal position, shown in solid lines in FIG. 1, the guides 24 move with it, so that the roller 22 may be rotated in the reverse direction to feed paper out along the underside of the plate 26 from around the roller 22. The paper passes between an anvil 28 and the stylus 14. The anvil 28 is a strip of resilient material secured to the underside of the plate 26. The anvil extends along the plate 26 parallel to the axis of the roller 22, and has substantially the same length as the roller axis.

A releasable locking catch 30 is provided to hold the guide plate 26 in its horizontal position.

The stylus 14 is mounted on a frame 32 and is movable vertically, by means described later, into and out of a position in which it is urged against the anvil 28, so as to impress the paper interposed between the stylus and anvil. The stylus 14 is also movable in a horizontal plane, by means described below. Thus, when the stylus is in its raised position, and is impressing a paper sheet, embossed lines or curves such as those forming a Moon character may be produced in the paper by appropriate movement of the stylus.

The horizontal position of the stylus is controlled by the user of the machine. The describing member 16 is a ring 16 (see FIG. 2) of suitable size to accommodate a finger of a user. The ring 16 is positioned above a fingerboard 34, and may move in a horizontal plane above the fingerboard 34.

The coupling 18 couples the stylus 14 to the ring 16 and causes the stylus to follow horizontal motion of the ring 16. As the user describes a shape or character by running his finger over the fingerboard 34 (with his finger in the ring 16), the same character is described by the stylus 14. If the stylus 14 is in its raised position, the character described on the fingerboard 34 is reproduced as an embossed character in the paper sheet. The fingerboard 34 may have grooves, or ridges or other formations to guide the user's finger, so as to facilitate describing characters. When the machine is to be used to emboss characters having common components, for instance vertical, horizontal or diagonal strokes, or arcuate curves, grooves representing all these components may be formed on the fingerboard, so that the user's finger is guided to describe an element correctly once the finger is positioned in the appropriate groove.

The coupling 18 will now be described in more detail with reference to FIGS. 1, 2 and 3. A first portion of the coupling 18 is a pantograph mechanism 36 shown most clearly in FIG. 2, and comprising a driving bar 38 in which the ring 16 is formed at one end, and a following bar 40. Two intermediate bars 42, 44 are pivotally connected to the driving bar 38 and to the following bar 40. The seperations of the pivot points on the bars 38 and 40 are the same, and the seperations of the pivot points on the bars 42, 44 are the same. Accordingly, the bars 38, 40, 42, 44 always form a parallelogram. The intermediate bar 42 extends from the driving bar 38 beyond the following bar 40 to a fixed pivot point 48 of the pantograph, where the bar 42 is fixed to the casing of the machine.

The following bar 40 is connected to the overlying frame 32, on which the stylus 14 is carried, by a ball and socket joint at 50.

Figure 2:
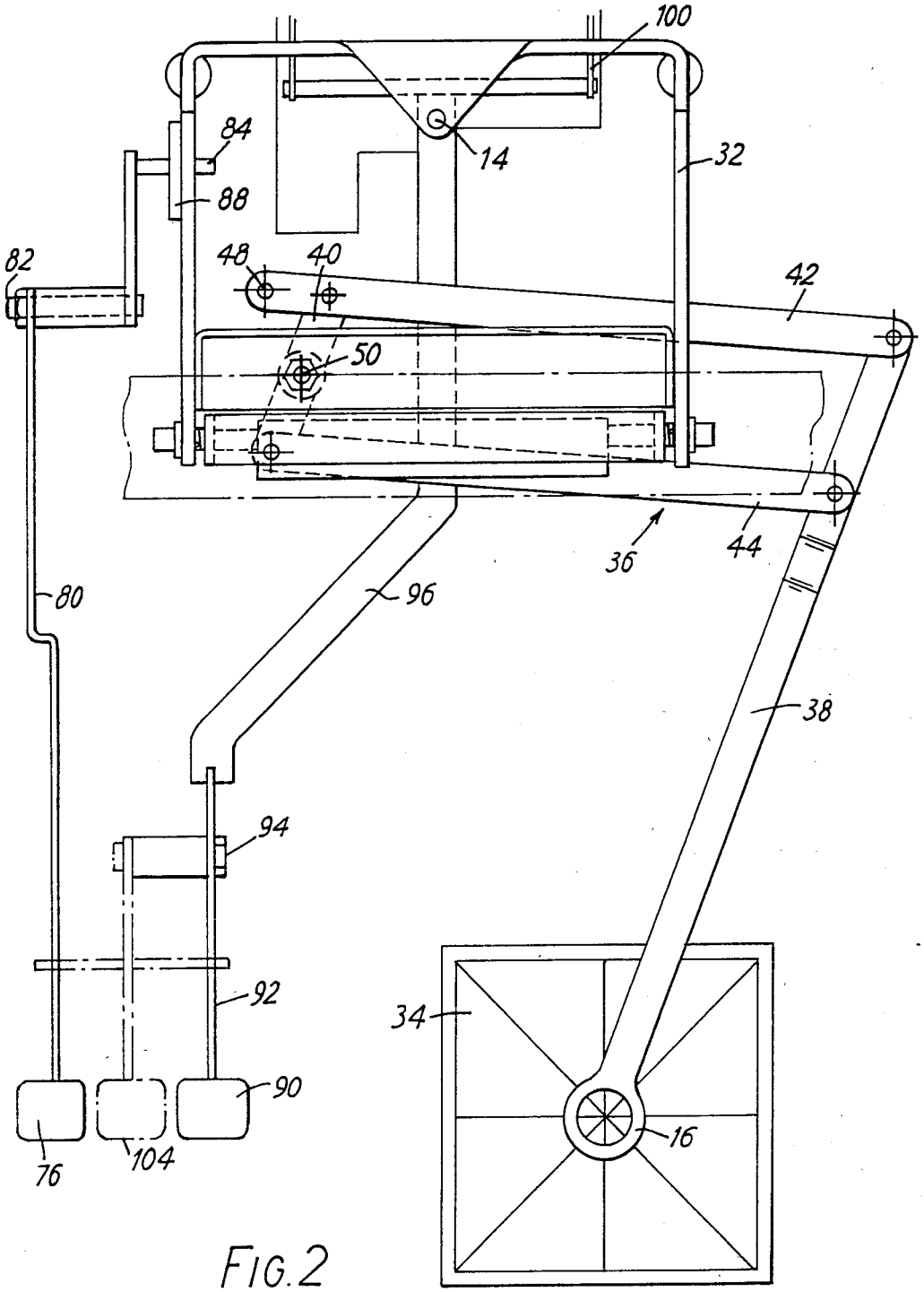
FIG. 2 is a plan view of part of the mechanism of FIG. 1.
Figure 3:
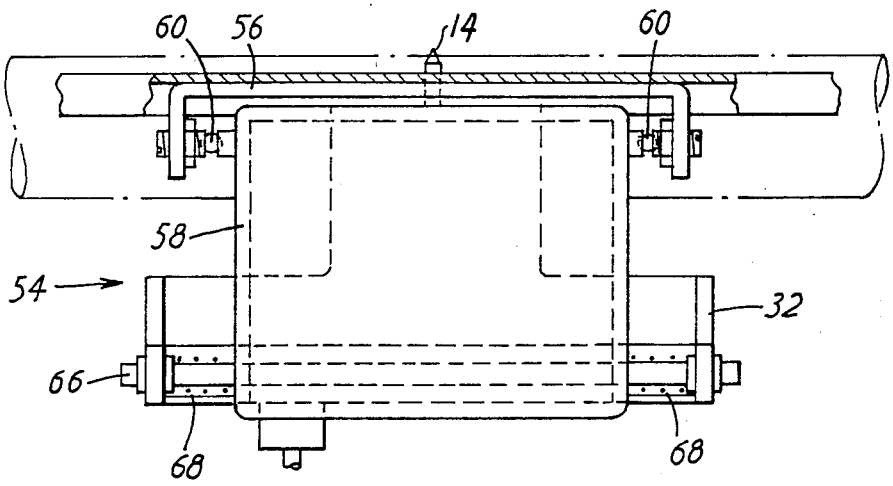
FIG. 3 is a partial end elevation of the mechanism of FIG. 1, viewed from the left in FIG. 1.

The frame 32 is supported at one end by a support mechanism 54, shown in FIGS. 1 and 3, but not in FIG. 2.

The support mechanism 54 comprises a bracket 56 fixed to the casing of the machine. A rectangular frame 58 is hung from the bracket 56 by ball joints 60 which allow the frame 58 to pivot about a horizontal axis 62 transverse to the machine, that is, perpendicular to the plane of FIG. 1. At its lower end, the frame 58 is pivotally connected about the horizontal axis 64 to the frame 32. The axis 64 is parallel to the axis 62.

The pivots 62 and 64 allow the frame 32 to move fore and aft in the machine (that is, in the plane of FIG. 1). Transverse movement (out of the plane of FIG. 1) is accommodated by a bar 66 fixed, for instance by brazing, to the frame 58 and slidably received in holes in the sides of the frame 32. Springs 68 act between the frames 32, 58 to provide some resistance against relative movement of the frames and tend to centre the frame 58 with respect to the frame 32.

The pantograph mechanism 36 serves to reduce the magnitude of the movements of the joint 50, as compared with the ring 16. The reduced amplitude motion is transmitted to the stylus 14. Thus, large movements of the ring 16 are required to produce standard size embossed characters. The necessary larger movements make it easier for a user to emboss a character accurately.

Referring again to FIG. 1, the paper support 12 is mounted on a slider 70 which is slidable on a track 72. The track 72 is transversely oriented in the machine 10, so that the support 12 may move transversely, i.e. perpendicular to the plane of FIG. 1. Movement of the support 12 along the track 72 is controlled by escapement mechanism 20, which is an escapement mechanism. The escapement, track and slider may be from an ordinary typewriter.

Each time the escapement mechanism 20 is operated by the user, the support 12 moves one step along the track 72 to present a fresh area of paper to the stylus 14 for embossing. Thus, a line of embossed characters may be generated by repeated operation of the escapement mechanism 20, a character being embossed each time the support 12 is stationary. At the end of a line, the roller 22 may be rotated to feed a new strip of paper under the anvil 28 and the support 12 may be moved back to its original position on the track 72. These actions are the same as the actions taken when the end of a line of typing is reached on a typewriter. A new line of characters can then be embossed on the new strip of paper under the anvil 28. Preferably the escapement mechanism is the tabulation part of a typewriter mechanism. Moon characters are larger than ordinary typewritten characters, and the tabulation mechanism can be set during manufacture to step the support 12 by several normal typewriter spaces at each operation, so that embossed characters are not superimposed on each other.

The describing member 16, its associated mechanism and its use have already been described. Other operator controls are shown in FIGS. 1 and 2.

A stylus control key 76 controls the vertical position of the stylus 14. The key is fixed to a first end of a lever 80 which is pivoted part way along its length at 82, and carries a pin 84 at its end remote from the key 76. The pin runs in a slot 86 in a bracket 88 mounted on the bottom of the frame 32. When the key 76 is depressed, the pin 84 is lifted, the frame 32 rocks on the joint 50 (about a horizontal axis transverse to the machine), moving up against the action of a tension spring 89. Thus, the stylus 14 rises, to a position in which it is urged against the anvil 28, and impresses paper between it and the anvil 28. Only a small range of vertical movement of the stylus 14 is required. As the stylus rises, a small amount of movement of the coupling at 64 and rotation of the frame 58 about the axis 62 is required.

A paper movement key 90 allows the operator to operate the escapement mechanism 20, to move the support 12 step-wise along the track 72. The key 90 is mounted on a bar 92 pivoted at 94 and loosely connected to a slider bar 96. The slider bar 96 is connected to a rod 98 via a lever 100 and a bracket 102. When the key 90 is depressed, the rod 98 is raised and operates the escapement mechanism 20 to move the support 12 one step along the track 72. The support 12 is moved as the key 90 is released.

A third key 104 may be incorporated. This key simply operates both keys 76, 90, so that the stylus 14 is raised when the key 104 is depressed and the support 12 is moved when the key 104 is released.

The machine is used as follows. A sheet of paper is fed in around the roller 22 as described above. The support 12 and roller 22 are then moved until the area of paper on which the first character is to be embossed is presented to the stylus 14. This area is represented to the user by the fingerboard 34. The user places his finger in the ring 16 and moves the ring to the point on the fingerboard at which he wishes to begin tracing a character. The stylus 14 follows, moving to a position beneath the equivalent point in the area of paper available for embossing. One of the keys 76, 104 is then depressed to raise the stylus 14, and the operator describes the desired character on the fingerboard 34. The stylus follows, moving with reduced amplitude and embossing the character on the paper.

When the character is finished, the key 76 or 104 is released, lowering the stylus 14. If the key 104 was used, the escapement 20 moves the support 12 by one step, so that embossing of the next character can begin.

If the key 76 was used, the key 90 must be depressed to move the support 12. The reason for having both keys 76 and 104 is as follows. Some Moon characters comprise a single line or curve only. These can be produced in a single embossing action, and it is convenient if the support moves as soon as the action ends. For these characters, the key 104 is used to raise the stylus.

Other characters comprise a line or curve, and one or more dots, for instance. For these characters, the stylus is raised using the key 76 to emboss the first part of the character. The stylus is then lowered, moved and raised again to emboss the second part of the character, without the support 12 having been moved. When the final part of the character is to be embossed, the stylus may be raised by the key 104 so that the support 12 moves when the key is released.

The machine described is intended to be used by blind people for writing Moon script. However, other uses are possible, for instance other embossed scripts could be produced. Wide variations of the mechanisms described, especially those for controlling the position of the stylus, are possible within the scope of the invention.

Some of the mechanisms of the machine described may be from an ordinary typewriter. Conveniently, the machine may be built in the casing of the typewriter, after the unwanted parts of the typewriter have been removed.

What is claimed is:

1. A sheet material embossing machine for generating a line of embossed characters, said machine comprising a sheet material support, an embossing stylus, stylus moving means operable to move said stylus with respect to said support into and out of a position in which said stylus impresses sheet material supported on said support, a finger board, a manually movable describing member positioned above the finger board, tracery means on the finger board for guiding said manually movable describing member positioned above the finger board operable to effect movement thereof in a horizontal plane above the finger board to describe the character to be embossed on the sheet material on said support, a coupling between said describing member and one of said stylus and said support, said coupling causing relative movement between said stylus and said support, said relative movement following movement of said describing member, said machine further comprising drive means operable to move said support in a transverse, stepwise manner relative to said stylus to present successive transverse areas of the sheet material supported on said support to said stylus, and means for effecting stepwise longitudinal movement of the sheet material relative to the stylus to present successive longitudinal areas of the sheet material supported on said support to said stylus.

2. A machine according to claim 1, wherein said coupling couples said stylus to said describing member and said drive means drives said the support.

3. A machine according to claim 1, wherein said relative movement between said stylus and said support is reduced in amplitude with respect to said movement of said describing member.

4. A machine according to claim 3, wherein said coupling comprises a pantograph mechanism for reducing the amplitude of movement.

5. A machine according to claim 1, wherein said describing member is movable in a plane, said stylus is movable in a plane parallel to said plane of movement of said describing member and said stylus is mounted on a frame, said frame being pivotable about an axis parallel to said planes of movement, to move said stylus into and out of its sheet-impressing position.

6. A machine according to claim 1, wherein said support comprises an anvil of resilient material, said stylus being urged against said anvil when in its sheet impressing position, to impress sheet material positioned between said stylus and said anvil.

7. A machine according to claim 1, wherein said support comprises a roller around which a sheet of embossable material may be coiled, and from around which said sheet may be uncoiled to take up a position in which an area of said sheet is presented to said stylus.

8. A machine according to claim 1, comprising a first control key operable to move said stylus into its sheet-impressing position and a second control key operable to cause said drive means to move said support relative to said stylus.

9. A machine according to claim 8, further comprising a third control key operable to operate said first and said second control keys.

10. A machine according to claim 1, in which the drive means comprise a typewriter escapement.

11. A sheet material embossing machine for generating a line of embossed characters, said machine comprising a sheet material support, an embossing stylus, stylus moving means operable to move said stylus with respect to said support into and out of a position in which said stylus impresses sheet material supported on said support, a finger board, a manually-movable describing member positioned above the finger board containing a finger-receiving opening within which a finger can be engaged to effect movement thereof in a horizontal plane above the finger board to describe the character to be embossed, a coupling between said describing member and one of said stylus and said support, said coupling causing relative movement between said stylus and said support, said relative movement following movement of said describing member, said machine further comprising drive means operable to move said support in a transverse, stepwise manner relative to said stylus to present successive transverse areas of the sheet material supported on said support to said stylus and means for effecting stepwise, longitudinal movement of the sheet material relative to the stylus to present successive longitudinal areas of the sheet material supported on said support to said stylus.

12. A sheet material embossing machine for generating a line of embossed characters, said machine comprising a sheet material support, an embossing stylus, stylus moving means operable to move said stylus with respect to said support into and out of a position in which said stylus impresses sheet material supported on said support, a describing member movable to describe the outline of a character to be embossed, said describing member comprising a ring for receiving a finger of the user so that said describing member follows the movement of said finger, a coupling between said describing member and one of said stylus and said support, a finger board across the surface of which said finger may be moved while in said ring, said finger board being provided with surface formations for guiding said finger, a coupling between said describing member and one of said stylus and said support, said coupling causing relative movement between said stylus and said support, said relative movement following movement of said describing member, said machine further comprising drive means operable to move said support in a stepwise manner relative to said stylus to present successive areas of sheet material supported in said support to said stylus.

13. A sheet material embossing machine for generating a line of embossed characters, said machine comprising a sheet material support, an embossing stylus, stylus moving means operable to move said stylus with respect to said support into and out of a position in which said stylus impresses sheet material supported in said support, a describing member movable to describe the outline of a character to be embossed, said describing member comprising a ring for receiving a finger of a user so that said describing member follows movement of said finger, a finger board across the surface of which said finger may be moved while in said ring, said finger board being provided with surface formations for guiding said finger, wherein said surface formations are grooves corresponding to elements of characters of an embossed writing system, a coupling between said describing member and one of said stylus and said support, said coupling causing relative movement between said stylus and said support, said relative movement following movement of said describing member, said machine further comprising drive means operable to move said support in a stepwise manner relative to said stylus to present successive areas of sheet material supported in said support to said stylus.

* * * * *